United States Patent [19]

Hanford

[11] 4,350,336

[45] Sep. 21, 1982

[54] EXERCISE TREADMILL SHOCK-ABSORBING IMPROVEMENT

[76] Inventor: Norris E. Hanford, P.O. Box 1283, Fort Benton, Mont. 59442

[21] Appl. No.: 196,458

[22] Filed: Oct. 14, 1980

[51] Int. Cl.[3] ..... A63B 23/06

[52] U.S. Cl. ..... 272/69; 198/841

[58] Field of Search ..... 272/69, 66, DIG. 4; 198/841, 842, 843

[56] References Cited

U.S. PATENT DOCUMENTS

| | | | |
|---|---|---|---|
| 2,239,076 | 4/1941 | Biedess | 198/841 |
| 2,251,766 | 8/1941 | Stark | 272/66 |
| 2,812,180 | 11/1957 | Cymbal | 272/66 |
| 2,996,295 | 8/1961 | Smith | 272/66 X |
| 3,319,767 | 5/1967 | Breternitz et al. | 198/841 X |
| 3,501,140 | 3/1970 | Eichorn | 272/69 UX |
| 3,590,980 | 7/1971 | Bengtsson | 198/841 |
| 3,814,420 | 6/1974 | Encke | 272/66 |
| 3,870,297 | 3/1975 | Elder | 272/69 X |

FOREIGN PATENT DOCUMENTS

| | | | |
|---|---|---|---|
| 1271191 | 7/1961 | France | 272/69 |
| 546523 | 3/1977 | U.S.S.R. | 198/841 |

*Primary Examiner*—Richard C. Pinkham
*Assistant Examiner*—Arnold W. Kramer

[57] ABSTRACT

An improvement to an exercise treadmill having longitudinal main frame members which comprises an adjustable shock-absorbing apparatus, featuring a flexible platform supporting a rotatable endless tread-belt, the platform being pivotally connected at one end to the main frame, with the platform resting on a moveable shock absorbing platform support which rests on the longitudinal main frame members and is located forward of the platform's pivotal connection, and which support is moveable fore and aft for adjustment purposes with respect to the longitudinal main frame members so as to act as a shock-absorbing fulcrum for the platform so as to protect the body of the exerciser from the shock usually associated with running or walking on a hard surface.

3 Claims, 3 Drawing Figures

EXERCISE TREADMILL SHOCK-ABSORBING IMPROVEMENT

FIELD OF THE INVENTION

This invention is an improvement feature for treadmills used by people who walk or jog as a means of exercise. More particularly, this invention minimizes the risk of body damage, which may be caused by the exerciser's feet striking hard and unyielding surfaces, by incorporating adjustable shock absorption as a feature of the threadmill.

DESCRIPTION OF THE PRIOR ART

Jogging and walking have become very popular as a means of achieving and/or maintaining a healthy body. Crime, bad weather, and other impediments to carefree jogging on the streets and in the parks, have made exercise treadmills increasingly popular for the home or office.

Foot, leg and back problems occur regularly among joggers, and generally such problems are attributable to jogging on hard and unyielding surfaces.

OBJECTS AND SUMMARY OF THE INVENTION

Due to the increasing use of exercise treadmills, the inventor has recognized the need to design the running surface in a manner better suited to the needs of the human body. Thus the intent of the invention is to facilitate safe and convenient exercise on an exercise treadmill by making walking or running on such a device so comfortable, so kind to the feet, legs and back, that this form of jogging or walking will have no equal.

As a walker or jogger uses this invention and as each foot strikes the tread-belt, the platform under the tread-belt depresses at its forward end, within the range of perhaps three-quarters ($\frac{3}{4}$) of an inch to one-eighth ($\frac{1}{8}$) inch. This variation in shock-absorbency is controlled by the exerciser, by his moving a resilient platform support either toward the front or toward the rear of the platform.

There are at least two types of platforms that support or underlie tread-belts on treadmills. In one type the tread-belt runs over a solid low-friction surface and in the other type, over a bank of rollers. This invention can be adapted to either type. It is here more fully described using the low-friction surface platform. With the low-friction surface platform, the shock-absorbing characteristics are attributable to two means; first, the platform flexes over the shock-absorbing support, similar to the action of a diving board; and second is the resiliency of the material, such as, for instance, rubber blocks built into the platform support.

A cushioned, shock-absorbing treadmill surface is very attractive to older persons who have to walk as therapy for heart condition and other health-related reasons, as well as to more vigorous people who might want to run at a six-minute-mile pace.

The present invention of a flexible treadmill platform, pivotally connected to the treadmill frame, and supported forward of the pivotal connection by a moveable resilient support, is extremely simple and maintenance-free, and is, therefore, a logical consumer product.

BRIEF DESCRIPTION OF DRAWINGS

Other benefits and advantages of the novel shock-absorbing apparatus will be apparent from the following description, and the accompanying drawings, in which.

DETAILED DESCRIPTION OF PREFERRED EMBODIMENT

Figure 1:
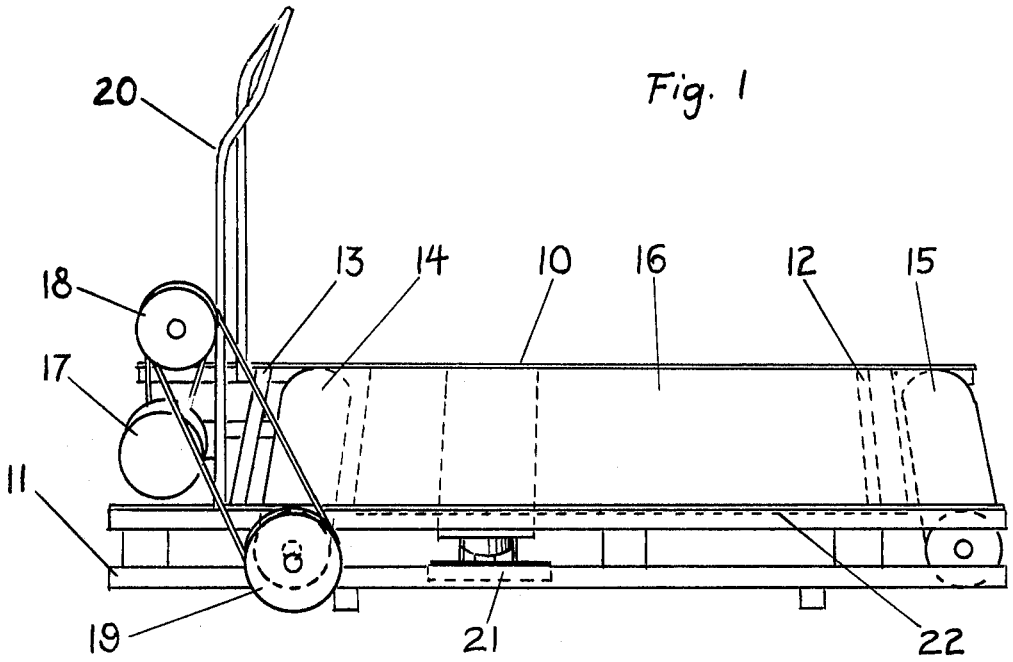
FIG. 1 is a side view in perspective of one form of the shock-absorbing apparatus and the treadmill of which it is a part.
Figure 2:
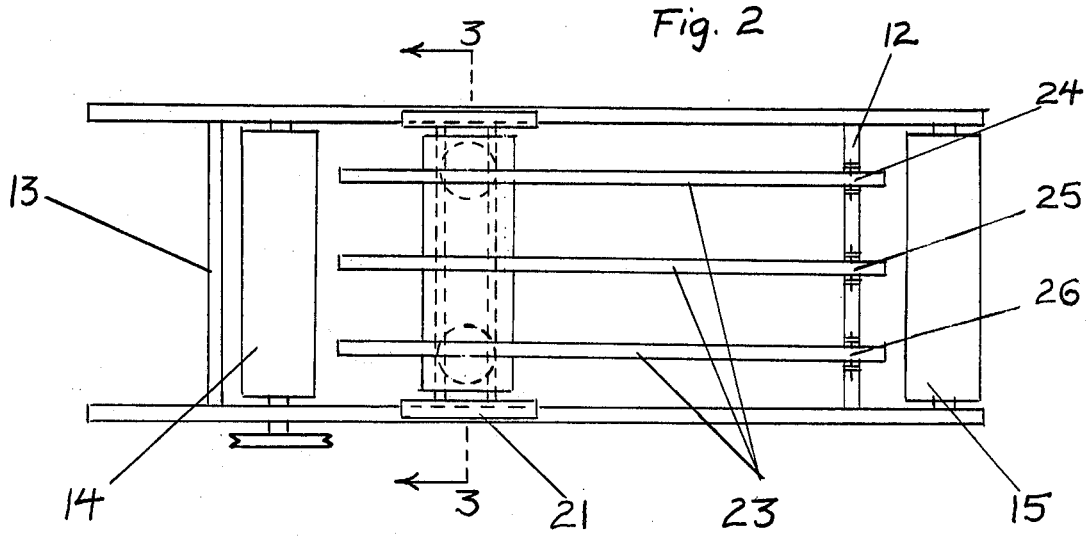
FIG. 2 is a top view of the treadmill with tread-belt and the low friction surface of the platform not shown, but with the longitudinal rails, which are a part of the platform, shown.
Figure 3:
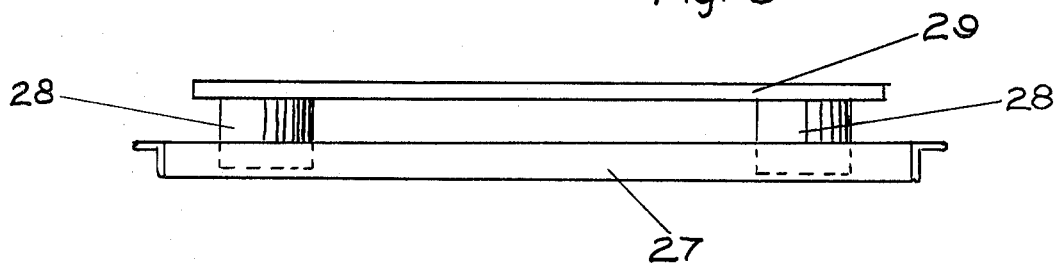
FIG. 3 is an enlarged view, in perspective, of one form of the shock-absorbing platform support taken along line 3—3 of FIG. 2.

As shown in the drawings, one form of the novel shock-absorbing apparatus includes a treadmill with longitudinal frame members 10 and 11, cross frame members 12 and 13, having rollers 14 and 15 attached ninety degrees to the longitudinal frame members 10 and 11 and located one forward and one to the rear, said rollers 14 and 15 carrying endless tread-belt 16, said tread-belt revolved around rollers 14 and 15 by an electric motor 17, through jack-shaft 18 and sheave 19, attached to roller 14, the front of the threadmill being toward handrail 20 which stands in front of the person exercising.

A shock-absorbing platform support 21 extends across the width of the platform 22 under platform rails 23, rails 23 being pivotally connected at 24, 25, and 26 to frame cross-member 12.

Shock-absorbing support 21 can be moved forward or backward by sliding on longitudinal frame members 10 and 11. Shock-absorbing platform support 21 has bottom supporting member 27 such as $\frac{3}{4}'' \times 3'' \times 20''$ by $\frac{1}{8}''$ channel iron with ends resting on frame sides 10 and 11, two rubber blocks 28, perhaps 2" in diameter and $1\frac{1}{2}''$ high, resting one on each end of member 27, board 29 resting on top of rubber blocks 28 and extending across the width of the platform 22 and upon which rails 23 of the platform rest. Thus the weight of the exerciser is transferred through the thread-belt 16 to the platform 22 to the frame member 12 at the pivotal connection and to the frame members 10 and 11 through the shock-absorbing platform support 21.

It can be seen that before the exerciser mounts the treadmill, he can at will slide the platform support 21 backward or forward to apportion his weight between the non-resilient pivotal connection 24, 25, 26 at the rear of the platform rails 23, and the resilient platform support 21. Obviously the exerciser, while exercising, can control, to some degree, the shock-absorption by simply positioning himself somewhat ahead or somewhat back in relation to the platform support 21.

In addition to the shock-absorbing action of the platform support 21, the platform 22 itself flexes longitudinally and is strengthened by rails 23 which may be, for instance, oak boards on edge, $\frac{3}{4}'' \times 2'' \times 53''$. The sliding of the platform support 21 either forward or backward obviously decreases or increases the flexibility of the platform 22.

The shock-absorbing features of the current invention are simple and may be easily adapted to fit most treadmills. The invention is unique in its simplicity. It dramatically protects the body of the exerciser from shock associated with running on a hard surface. A run on a treadmill equipped with this apparatus is a totally new and wonderful running experience.

It will be apparent that various modifications can be made in the particular shock-absorbing apparatus described in detail above, and shown within the drawings, within the scope of the invention. For example, the size, shape, and materials of the components can be changed to meet specific requirements. Also, the arrangement of the components can be modified to adapt to different model treadmills in order to achieve the shock-absorbing objectives of the invention. Therefore, the scope of the invention is to be limited only by the following claims.

What is claimed is:

1. An exercise treadmill which comprises:

a longitudinal main frame;

an endless tread-belt mounted on said frame and having an upwardly exposed operative section;

a belt support platform having front and rear ends, said platform underlying said operative section of said belt and being connected proximate its rear end to said frame; and shock-absorbing platform support means on said frame upon which said platform rests at a location forward of said connection, said support means being movable fore and aft on said frame for adjustment purposes so as to act as a shock-absorbing fulcrum for the platform so as to protect the body of the exerciser from the shock usually associated with running or walking on a hard surface.

2. An exercise treadmill as defined in claim 1, wherein said connection is a hinged connection.

3. An exercise treadmill as defined in either of claims 1 or 2, wherein said platform is longitudinally flexible.

* * * * *